US011212601B1

(12) United States Patent
Kervran

(10) Patent No.: US 11,212,601 B1
(45) Date of Patent: Dec. 28, 2021

(54) SOUND TRANSDUCER AND ELECTRONIC DEVICE

(71) Applicant: AAC ACOUSTIC TECHNOLOGIES (SHENZHEN) CO., LTD., Shenzhen (CN)

(72) Inventor: Yannick Kervran, HK (FR)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/066,450

(22) Filed: Oct. 8, 2020

(51) Int. Cl.
*H04R 19/04* (2006.01)
*H04R 1/02* (2006.01)

(52) U.S. Cl.
CPC ..... *H04R 1/02* (2013.01)

(58) Field of Classification Search
CPC ..... H04R 19/005; H04R 19/016; H04R 2201/003; B81B 2201/0257; B81B 2203/0136
See application file for complete search history.

(56) References Cited

U.S. PATENT DOCUMENTS 8,755,556 B2 * 6/2014 Cohen ..... H04R 31/00 381/398
9,131,319 B2 * 9/2015 Zoellin ..... H04R 23/00
9,402,137 B2 * 7/2016 Hsu ..... H04R 19/005
9,510,121 B2 * 11/2016 Xu ..... H04R 1/04
9,728,653 B2 * 8/2017 Dehe ..... H04R 19/005
9,809,444 B2 * 11/2017 Klein ..... B81B 3/0021
9,938,133 B2 * 4/2018 Kautzsch ..... B81B 3/0021
10,349,188 B2 * 7/2019 Meisel ..... H04R 19/04
10,715,925 B2 * 7/2020 Zhang ..... B81B 3/0021
2002/0118850 A1 * 8/2002 Yeh ..... B81B 3/0072 381/313
2020/0296519 A1 * 9/2020 Wu ..... H04R 19/04

* cited by examiner

*Primary Examiner* — Ryan Robinson
(74) *Attorney, Agent, or Firm* — W&G Law Group

(57) ABSTRACT

A sound transducer includes a substrate including a first surface, a second surface, and a cavity, a support structure disposed on the first surface and including an inner peripheral edge and a third surface, a fixing structure disposed on the third surface, a moving structure including an exterior peripheral edge and a fourth surface, a first set of comb fingers fixed to the inner peripheral edge, extending toward the moving structure, and being electrically isolated from the fixing structure and the moving structure, a second set of comb fingers fixed to the exterior peripheral edge, extending toward the support structure, and interdigitated with the first set of comb fingers, and an elastic connecting structure including a first connecting part connected to the fourth surface, a second connecting part connected to the fixing structure, and an elastic body; the moving structure is disposed above the cavity.

20 Claims, 10 Drawing Sheets

B-B

SOUND TRANSDUCER AND ELECTRONIC DEVICE

TECHNICAL FIELD

The disclosure relates to the technical field of sound-electric conversion devices, and more particularly to a sound transducer and an electronic device comprising the sound transducer.

BACKGROUND

A Micro-Electro-Mechanical-System Microphone (MEMS)—based transducer includes a series of sensors and actuators produced using micromachining technology. Generally, MEMS can be used in accelerometers, microphones, micromotors, micropumps, microvibrators, pressure sensors, gyroscopes, humidity sensors, and the like. Many MEMS devices use capacitive sensing technology to convert physical signals into electrical signals. In this application, an interface circuit is used to convert a change in capacitance from the sensor into a voltage signal. In the related art, as shown in FIG. 1, a sound transducer 800 generates a capacitance change through relative sliding of the comb fingers. Due to design limitations, a connecting structure 803 which is configured between a moving structure 801 and a substrate 802 is arranged in an in-plane way. Thus, the displacement and the position at rest of the moving structure are limited, which affects the performance of the sound transducer.

Therefore, it is necessary to provide a sound transducer and an electronic device to improve sensitivity and performance.

SUMMARY

One of the objectives of the disclosure is to provide a sound transducer, so as to enlarge to control the displacement and position of at rest of a moving structure.

One of the objectives of the disclosure is realized by adopting the following technical scheme:

A sound transducer, comprises a substrate, a support structure, a fixing structure, a moving structure, a first set of comb fingers, a second set of comb fingers, and an elastic connecting structure; the substrate comprises a first surface, a second surface being opposite to the first surface, and a cavity extending from the first surface to the second surface; the support structure is disposed on the first surface, and comprises an inner peripheral edge near the cavity and a third surface away from the first surface; the fixing structure is disposed on the third surface; the moving structure is disposed above the cavity and at least partially covering the cavity, and comprises an exterior peripheral edge near the support structure and a fourth surface away from the cavity; the first set of comb fingers is fixed to the inner peripheral edge of the support structure, and extends toward the moving structure, and is electrically isolated from the fixing structure and the moving structure; the second set of comb fingers is fixed to the exterior peripheral edge of the moving structure, and extends toward the support structure; the elastic connecting structure is configured to connect the fixing structure and the moving structure; wherein the first set of comb fingers and the second set of comb fingers are interdigitated; the elastic connecting structure comprises a first connecting part, a second connecting part, and an elastic body connecting the first and second connecting parts, the first connecting part is connected to the fourth surface, and the second connecting part is connected to the fixing structure.

As an improvement, the first connecting part is provided with a first anchor connected to the fourth surface, the second connecting part is provided with a second anchor connected to the fixing structure, and the elastic connecting structure is configured to connect the moving structure to the fixing structure through the first and second anchors.

As an improvement, the first anchor comprises a plurality of first sub-anchors, and/or the second anchor comprises a plurality of second sub-anchors; the plurality of first sub-anchors is connected to the fourth surface, and the plurality of second sub-anchors is connected to the fixing structure.

As an improvement, the sound transducer comprises one fixing structure, the fixing structure is ring-shaped, and the second connecting part is connected to an inner side or a top of the fixing structure.

As an improvement, the sound transducer comprises one elastic connecting structure, and the elastic connecting structure is a ring structure; an inner side of the ring structure forms the first connecting part, an outer side of the ring structure forms the second connecting part, and the elastic body is provided with a vent hole.

As an improvement, the elastic body extends from the first connecting part away from the fourth surface toward the second connecting part.

As an improvement, the elastic body comprises a first body part and a second body part, the first body part extends from the first connecting part in a direction away from the fourth surface, and the second body part connects the first body part to the second connecting part.

As an improvement, the sound transducer comprises at least two fixing structures arranged separately in a circumferential direction, and the second connecting part is connected to an inner side or a top of the fixing structure.

As an improvement, the sound transducer comprises one elastic connecting structure, and the elastic connecting structure is a ring structure; an inner side of the ring structure forms the first connecting part, an outer side of the ring structure forms the second connecting part, and the elastic body is provided with a vent hole.

As an improvement, the elastic body extends from the first connecting part away from the fourth surface toward the second connecting part.

As an improvement, the elastic body comprises a first body part and a second body part, the first body part extends from the first connecting part in a direction away from the fourth surface, and the second body part connects the first body part to the second connecting part.

As an improvement, the sound transducer comprises at least two elastic connecting structures, and the two elastic connecting structures are arranged circumferentially along an inside of the fixing structure.

As an improvement, the elastic body is a linear structure or a wavy structure.

As an improvement, the wave structure is in a shape of sine waveform, square waveform, triangular waveform, or sawtooth waveform, or any combination thereof.

As an improvement, the sound transducer comprises at least two elastic connecting structures, a number of the elastic connecting structure is the same as a number of the fixing structure, and the second connecting part of one elastic connecting structure is connected to one fixing structure.

As an improvement, the elastic body is a linear structure or a wavy structure.

As an improvement, the wave structure is in a shape of sine waveform, square waveform, triangular waveform, or sawtooth waveform, or any combination thereof.

As an improvement, the moving structure is connected to at least one elastic connecting structure to form a resonant structure.

As an improvement, the elastic connecting structure is made of a material comprising a conductive material, or a non-conductive material, or a combination thereof, or a stack thereof.

As an improvement, the first surface is defined as a first plane, the first set of comb fingers comprise a first set of sub-comb fingers and a second set of sub-comb fingers, the first set of sub-comb fingers and the second set of sub-comb fingers are arranged separately in a direction perpendicular to the first plane, and both the first set of sub-comb fingers and the second set of sub-comb fingers are at least partially opposite to the second set of comb fingers in a direction parallel to the first plane; the first set of sub-comb fingers and the second set of sub-comb fingers are electrically isolated from each other.

The disclosure also provides an electronic device comprising the above-mentioned sound transducer, and the performance and sensitivity of the sound transducer are improved.

Advantages of the disclosure are summarized as follows: disposing the elastic connecting structure in the out-of-plane way enlarges to control the displacement and position at rest of the moving structure. In addition, the comb fingers can be arranged at the position where the elastic connecting structure is disposed in the in-plane way in the related art, which increases the number of comb fingers, and thus the sensing area is increased and the sensitivity of the sound transducer can be improved, and the performance of the sound transducer can be improved.

Figure 1:
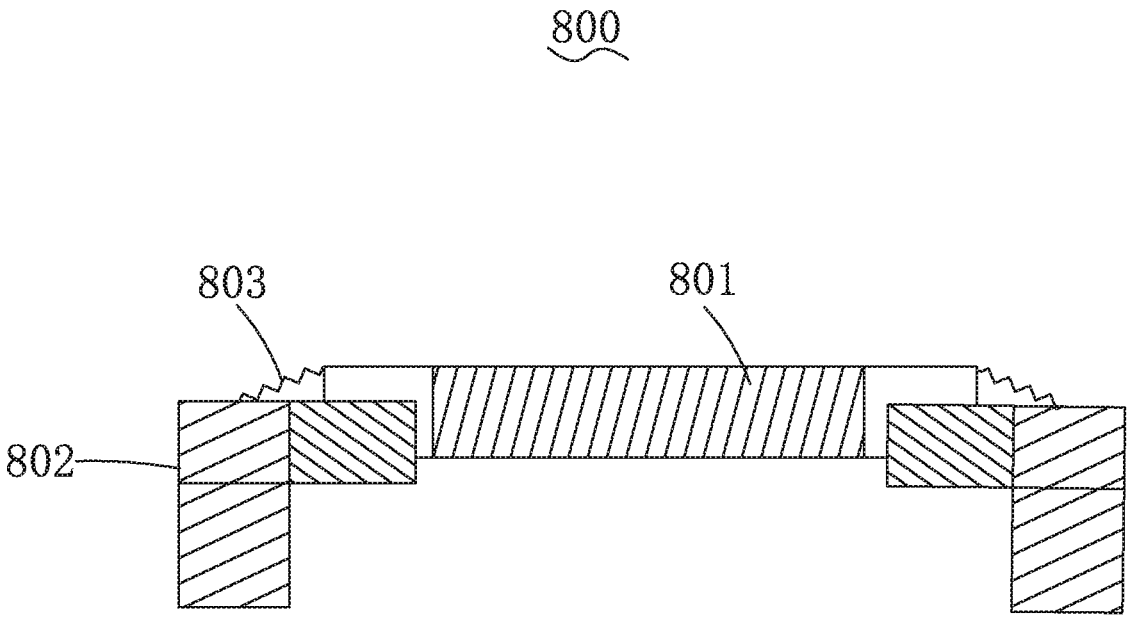
(prior art) Fig. 1
FIG. 1 is a cross sectional view of a sound transducer in the related art.

In the drawings, the following reference numbers are used: 100. Sound transducer; 1. Substrate; 11. First surface; 12. Second surface; 13. Cavity; 14. Fifth surface; 15. Sixth surface; 2. Support structure; 21. Third surface; 22. Inner peripheral edge; 3. Fixing structure; 4. Moving structure; 41. Exterior peripheral edge; 42. Fourth surface; 5. First set of comb fingers; 51. First set of sub-comb fingers; 52. Second set of sub-comb fingers; 6. Second set of comb fingers; 61. Third set of sub-comb fingers; 62. Fourth set of sub-comb fingers; 7. Elastic connecting structure; 71. First connecting part; 72. Second connecting part; 73. First anchor; 731. First sub-anchor; 74. Second anchor; 741. Second sub-anchor; 75. Elastic body; 751. First body part; 752. Second body part; 76. Vent hole.

DETAILED DESCRIPTION OF THE PREFERRED EMBODIMENTS

The disclosure is described in detail below in combination with FIGS. 2 to 15.

Example 1

As shown in FIGS. 2-7, the disclosure provides a sound transducer 100, and the sound transducer 100 comprises a substrate 1, a support structure 2, a fixing structure 3, a moving structure 4, a first set of comb fingers 5, a second set of comb fingers 6, and an elastic connecting structure 7. The substrate 1 comprises a first surface 11, a second surface 12, and a cavity 13 extending from the first surface 11 to the second surface 12. The second surface 12 is opposite to the first surface 11. The support structure 2 comprises an inner peripheral edge 22 near the cavity 13 and a third surface 21 away from the first surface 11 of the substrate 1, and is disposed on the first surface 11 of the substrate 1. The fixing structure 3 is disposed on the third surface 21 of the support structure 2. The moving structure 4 comprises an exterior peripheral edge 41 near the support structure 2 and a fourth surface 42 away from the cavity 13, and is disposed above the cavity 13 and at least partially configured to cover the cavity 13. The first set of comb fingers 5 are fixed to the inner peripheral edge 22 of the support structure 2 and extend toward the moving structure 4, the second set of comb fingers 6 are fixed to the exterior peripheral edge 41 of the moving structure 4 and extend toward the support structure 2, and the first set of comb fingers 5 and the second set of comb fingers 6 are interdigitated. The first set of comb fingers 5 are electrically isolated from the fixing structure 3 and the moving structure 4. The elastic connecting structure 7 comprises a first connecting part 71, a second connecting part 72, and an elastic body 75 connecting the first connecting part 71 and the second connecting part 72, the first connecting part 71 is connected to the fourth surface 42 of the moving structure 4, and the second connecting part 72 is connected to the fixing structure 3.

In the embodiment of the disclosure, the sound pressure acting on the moving structure 4 causes the moving structure 4 to move in a direction perpendicular to the plane where it is located, which drives the second set of comb fingers 6 to move relative to the first set of comb fingers 5 in the direction perpendicular to the plane where the moving structure 4 is located, thereby producing a signal of capacitance change between the first set of comb fingers 5 and the second set of comb fingers 6. By providing the fixing structure 3 disposed on the support structure 2, and disposing the elastic connecting structure 7 to be connected between the fixing structure 3 and the fourth surface 42 of the moving structure 4, so that the elastic connecting structure 7 is disposed at out-of-plane of the first set of comb fingers 5 and the second set of comb fingers 6, that is, the elastic connecting structure 7 is arranged in an out-of-plane way. Based on the related art, disposing the elastic connecting structure 7 in the out-of-plane way enlarges to control the displacement and position at rest of the moving structure 4. In addition, the comb fingers can be arranged at the position where the elastic connecting structure is disposed in the in-plane way in the related art, which increases the number of comb fingers, and increases the sensing area and thus the sensitivity of the sound transducer 100 is improved, and thus the performance of the sound transducer 100 can be improved. By electrically isolating the fixed structure 3 and the moving structure 4 from the first set of comb fingers 5, so that the influence to the capacitive coupling between the first set of comb fingers 5 and the second set of comb fingers 6 is decreased.

In this embodiment, the fixing structure 3 is a spacer, the first connecting part 71 of the elastic connecting structure 7 can be connected to any positions of the fourth surface 42 of the moving structure 4, and the second connecting part 72 of the elastic connecting structure 7 can be connected to any positions of the fixing structure 3, as long as the connecting structure 7 is disposed in out-of-plane way.

The first connecting part 71 is provided with a first anchor 73 connected to the fourth surface 42, the second connecting part 72 is provided with a second anchor 74 connected to the fixing structure 3, and the elastic connecting structure 7 connects the moving structure 4 to the fixing structure 3 through the first and second anchors. In the embodiment, the first anchor 73 can be divided into a plurality of first sub-anchors 731, the plurality of first sub-anchors 731 is connected to the fourth surface 42. For different mechanical purpose, in other embodiments, the second anchor 74 can be divided into a plurality of second sub-anchors 741, and the plurality of second sub-anchors 741 is connected to the fixing structure 3; or the first anchor 73 is divided into the plurality of first sub-anchors 731, and the second anchor 74 is divided into the plurality of second sub-anchors 741.

Preferably, the sound transducer 100 comprises one fixing structure 3, the fixing structure 3 is ring-shaped, and the second connecting part 72 is connected to an inner side or a top of the fixing structure 3; or the sound transducer 100 comprises at least two fixing structures 3 arranged separately in a circumferential direction, and the second connecting part 72 is connected to the inner side or the top of the fixing structure 3.

Figure 2:
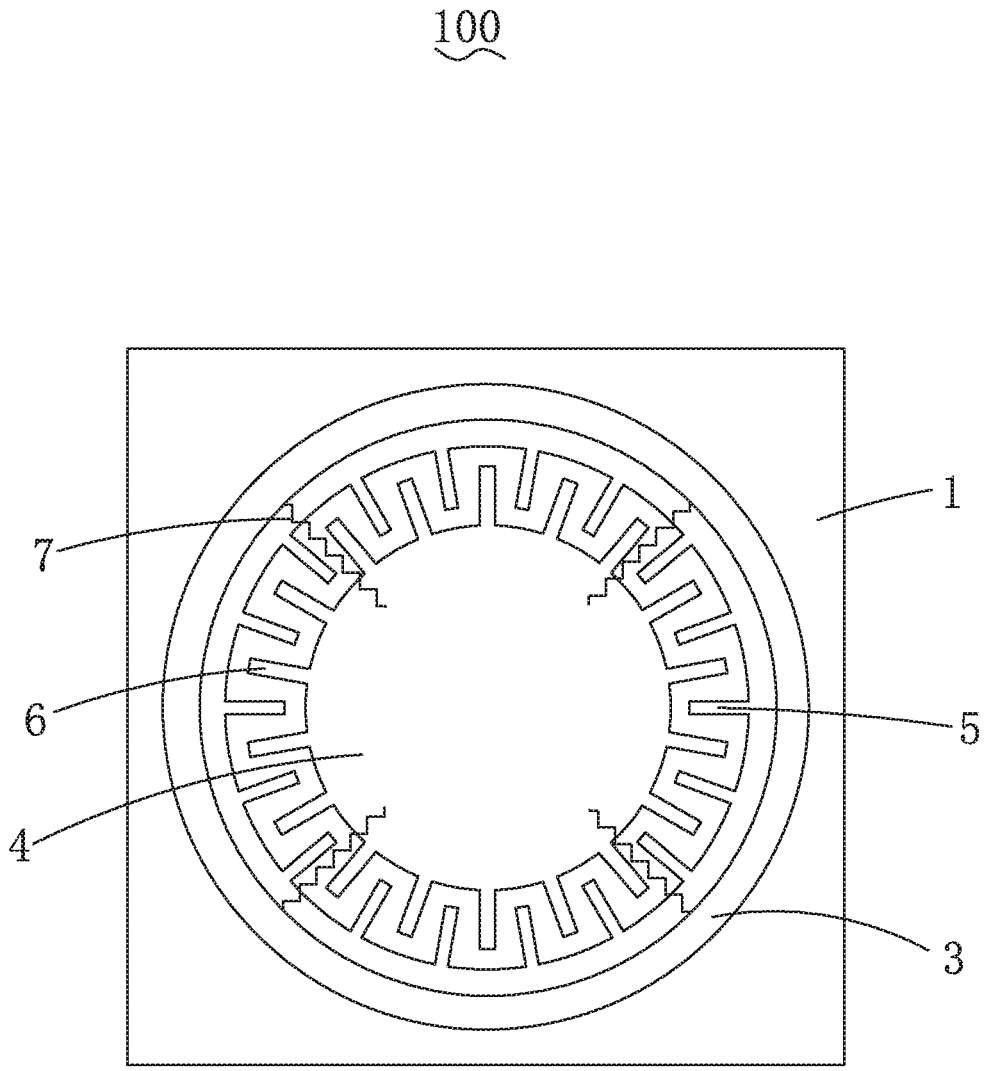
FIG. 2 is a top view of a first sound transducer according to a first embodiment of the disclosure.

As shown in FIG. 2, the sound transducer 100 comprises one fixing structure 3, and the fixing structure 3 is circular ring-shaped. It can be understood that the fixing structure 3 may also be a square ring-shaped, a polygon ring-shaped, an irregular ring-shaped, or the like.

Preferably, the sound transducer 100 comprises at least two elastic connecting structures 7, and the two elastic connecting structures 7 are arranged circumferentially along an inside of the fixing structure 3. As shown in FIG. 2, the sound transducer 100 is provided with four elastic connecting structures 7, and the four elastic connecting structures 7 are connected to the circular ring-shaped fixing structure 3.

Figure 3:
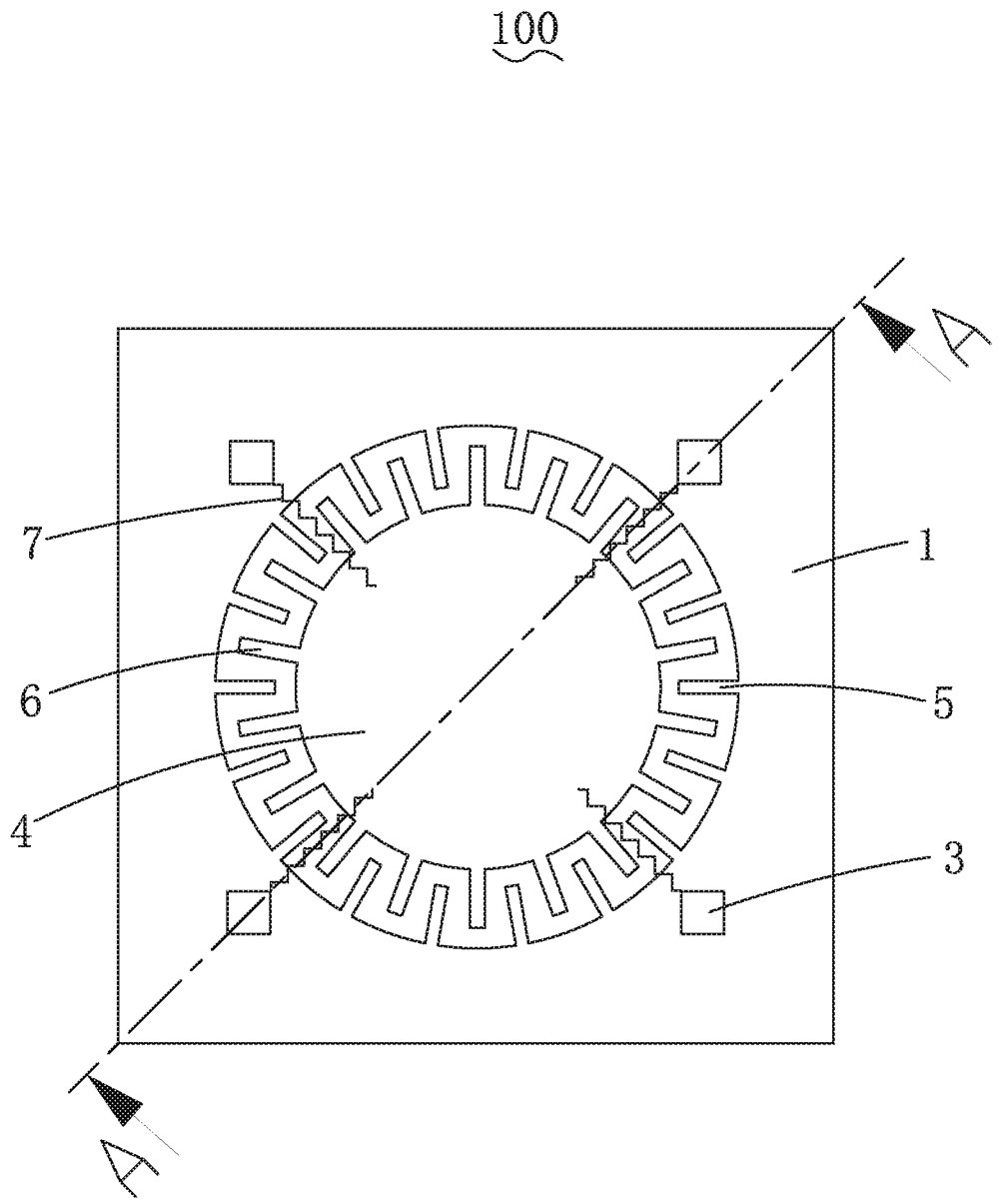
FIG. 3 is a top view of a second sound transducer according to the first embodiment of the disclosure.

In some embodiments, the sound transducer 100 may comprise a plurality of fixing structures 3 and a plurality of elastic connecting structures 7, the number of the elastic connecting structure 7 is the same as the number of the fixing structure 3, and the second connecting part 72 of one elastic connecting structure 7 is connected to one fixed structure 3. As shown in FIG. 3, the sound transducer 100 comprises four elastic connecting structures 7 and four fixing structures 3, the four elastic connecting structures 7 and the four fixing structures 3 are arranged at regular intervals, and the second connecting part 72 of one elastic connecting structure 7 is connected to one fixing structure 3. In some embodiments, the plurality of elastic connecting structures 7 can be disposed at non-equidistant intervals.

As shown in FIGS. 8 to 12, the elastic body 75 is a linear structure or a wavy structure. The wave structure is in a shape of sine waveform, square waveform, triangular waveform, or sawtooth waveform, or any combination thereof. Understandably, the shape of the elastic body 75 is not limited by this embodiment and the figures, and can be any shape.

Preferably, the moving structure 4 is connected to at least one elastic connecting structure 7 to form a resonant structure.

Preferably, the elastic connecting structure 7 is made of a material containing a conductive material, or a non-conductive material, or a combination of conductive and non-conductive material, or a stack of those materials. When it is made of conductive material, the elastic connecting structure 7 can send electrical signal, the fixing structure 3 is electrically connected to the moving structure 4 by the elastic connecting structure 7, and the first set of comb fingers 5 is electrically isolated from the fixing structure 3. Or in other embodiment, the second set of comb fingers 6 is electrically isolated from the moving structure 4. Only if the first set of comb fingers 5 and the second set of comb fingers 6 are not series connected.

Figure 6:
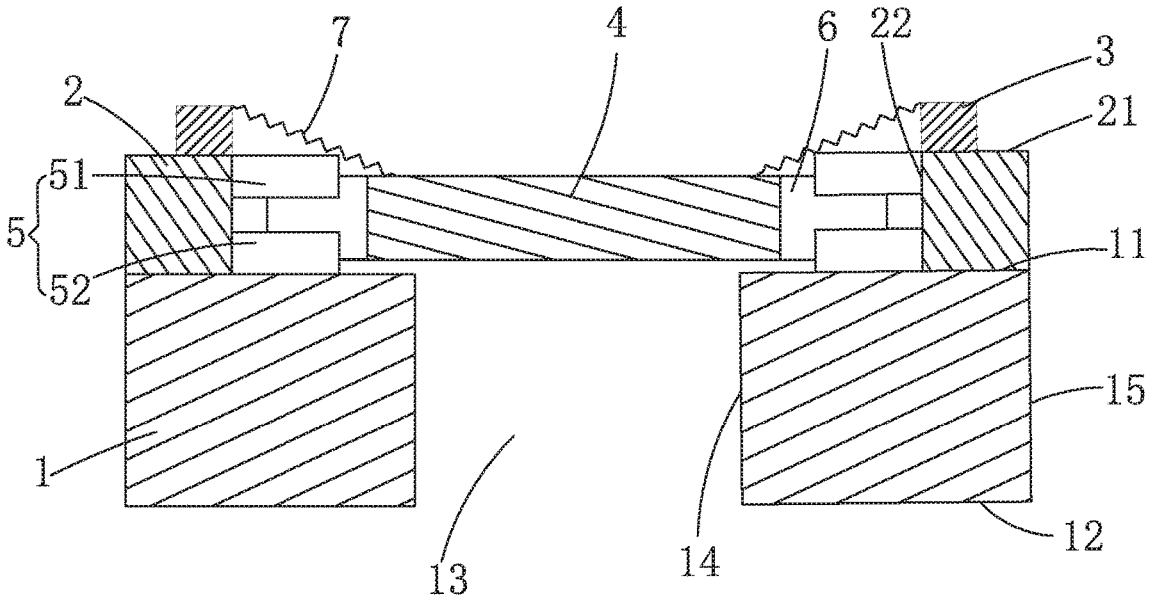
FIG. 6 is a cross sectional view of a sound transducer in which a first set of comb fingers comprise a first set of sub-comb fingers and a second set of sub-comb fingers.
Figure 7:
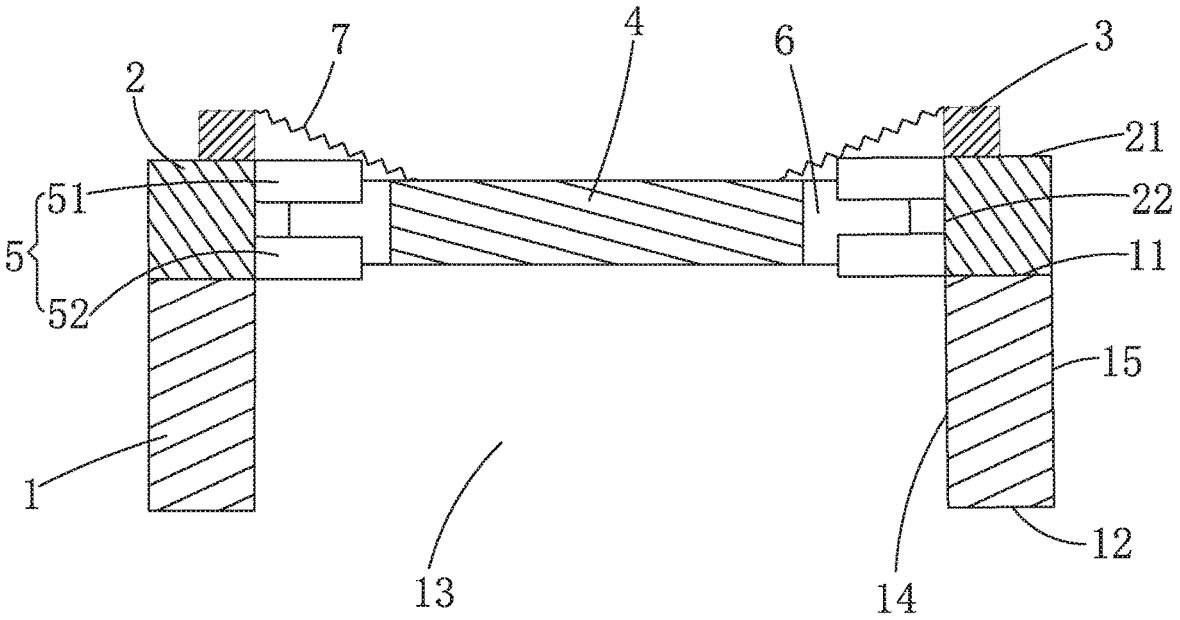
FIG. 7 is a cross sectional view of a sound transducer in which a first set of comb fingers are suspended and comprise a first set of sub-comb fingers and a second set of sub-comb fingers.
Figure 8:
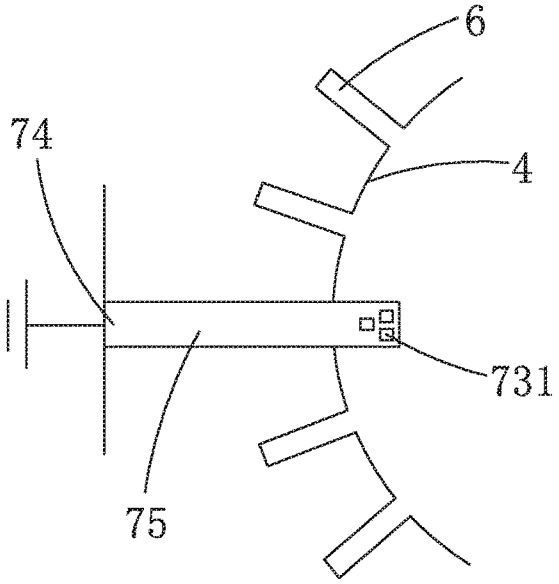
FIG. 8 is a top view of an elastic connecting structure having a linear body.
Figure 9:
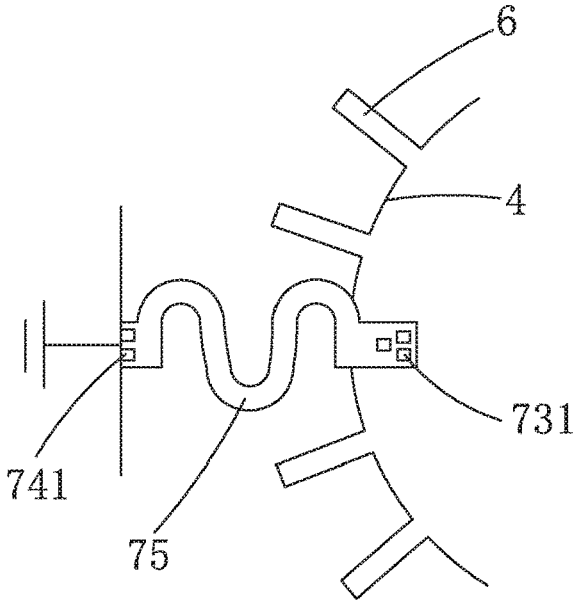
FIG. 9 is a top view of a first elastic connecting structure having a wavy body.
Figure 10:
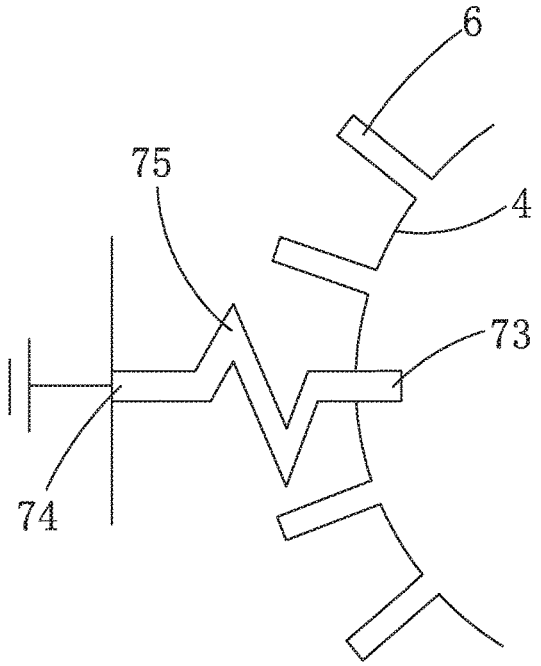
FIG. 10 is a top view of a second elastic connecting structure having a wavy body.
Figure 11:
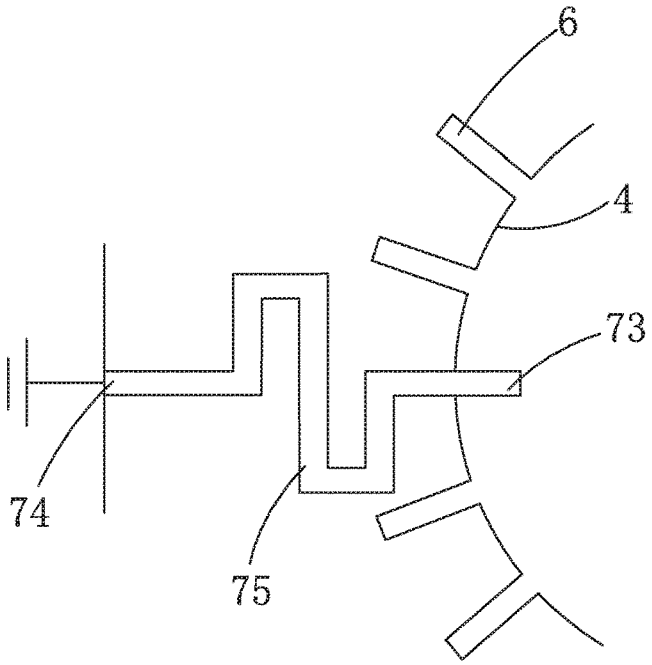
FIG. 11 is a top view of a third elastic connecting structure having a wavy body.
Figure 12:
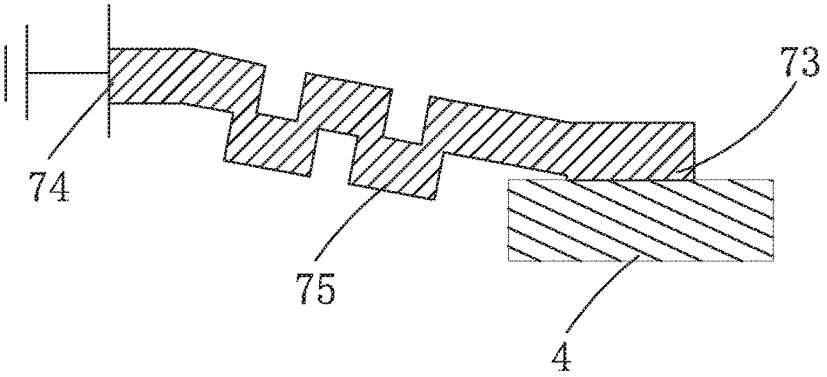
FIG. 12 is a cross sectional view of a fourth elastic connecting structure having a wavy body.
Figure 16:
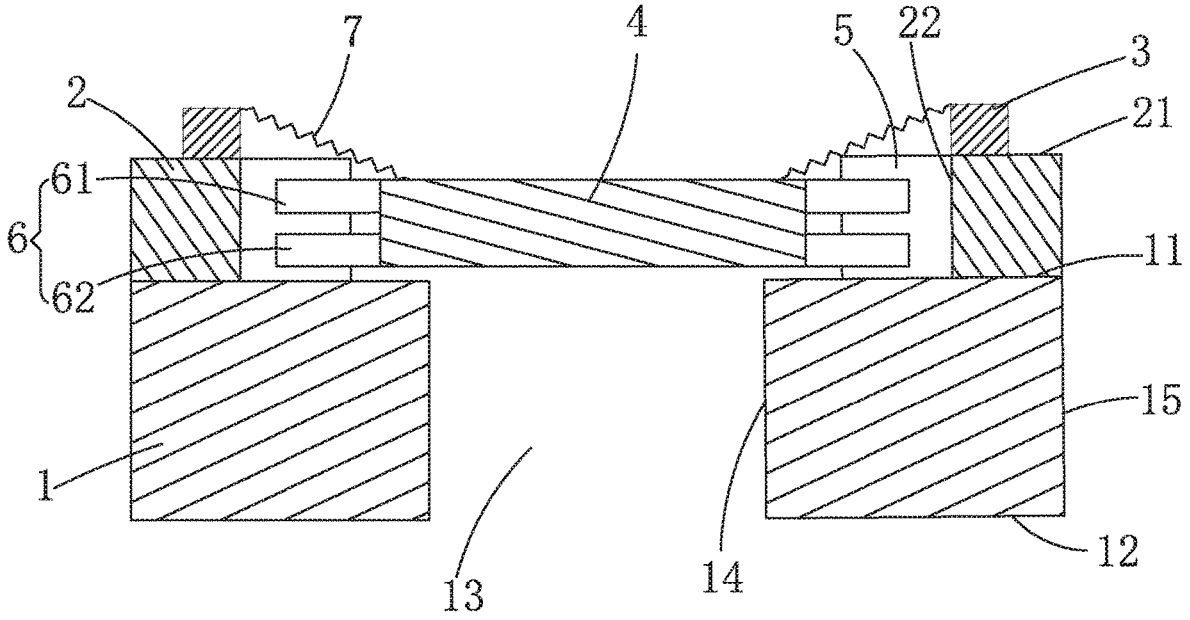
FIG. 16 is a cross sectional view of a sound transducer in which a second set of comb fingers comprise a third set of sub-comb fingers and a fourth set of sub-comb fingers.

As shown in FIG. 6 and FIG. 7, the first surface 11 is defined as a first plane, the first set of comb fingers 5 comprise a first set of sub-comb fingers 51 and a second set of sub-comb fingers 52, the first set of sub-comb fingers 51 and the second set of sub-comb fingers 52 are arranged separately in the direction perpendicular to the first plane, and both the first set of sub-comb fingers 51 and the second set of sub-comb fingers 52 are at least partially opposite to the second set of comb fingers 6 in a direction parallel to the first plane. The first set of sub-comb fingers 51 are electrically isolated from each other, and the second set of sub-comb fingers 52 are also electrically isolated from each other, and the first set of sub-comb fingers 51 and the second set of sub-comb fingers 52 are both electrically isolated from the moving structure 4 and the fixed structure 3, respectively, which decreases the influence to the capacitive coupling between the first set of comb fingers 5 and the second set of comb fingers 6. Similarly, as shown in FIG. 16, the second set of comb fingers 5 comprise a third set of sub-comb fingers 61 and a fourth set of sub-comb fingers 62.

Figure 4:
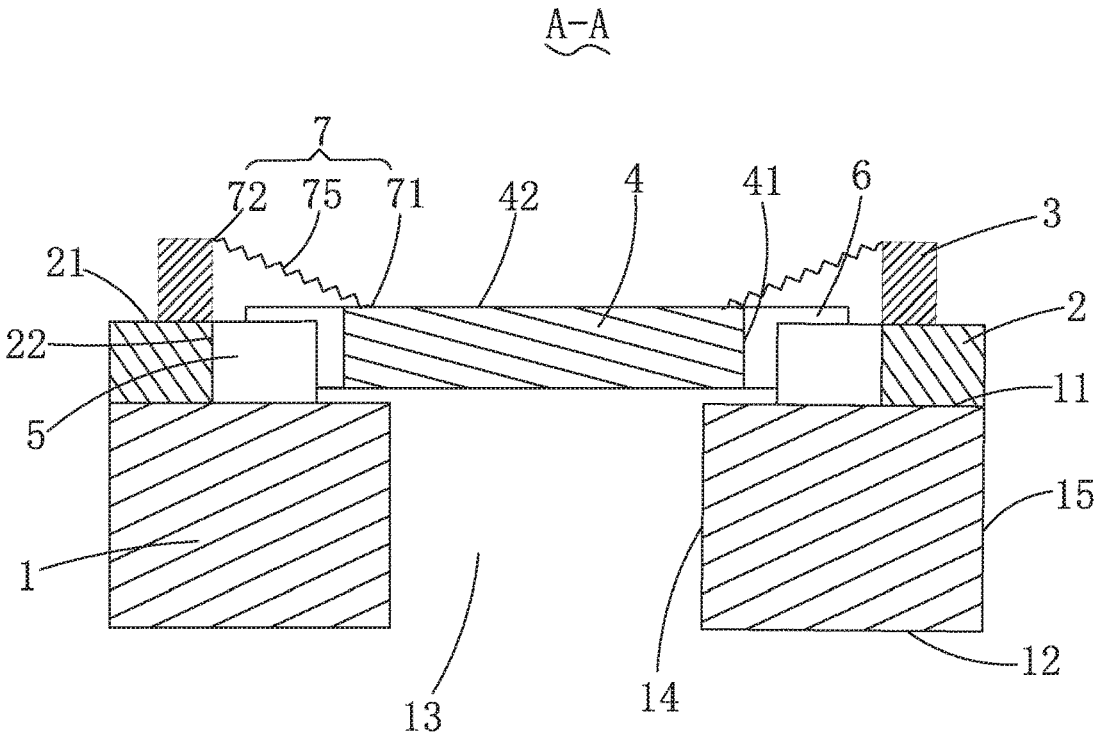
FIG. 4 is a cross sectional view taken from line A-A in FIG. 3.
Figure 5:
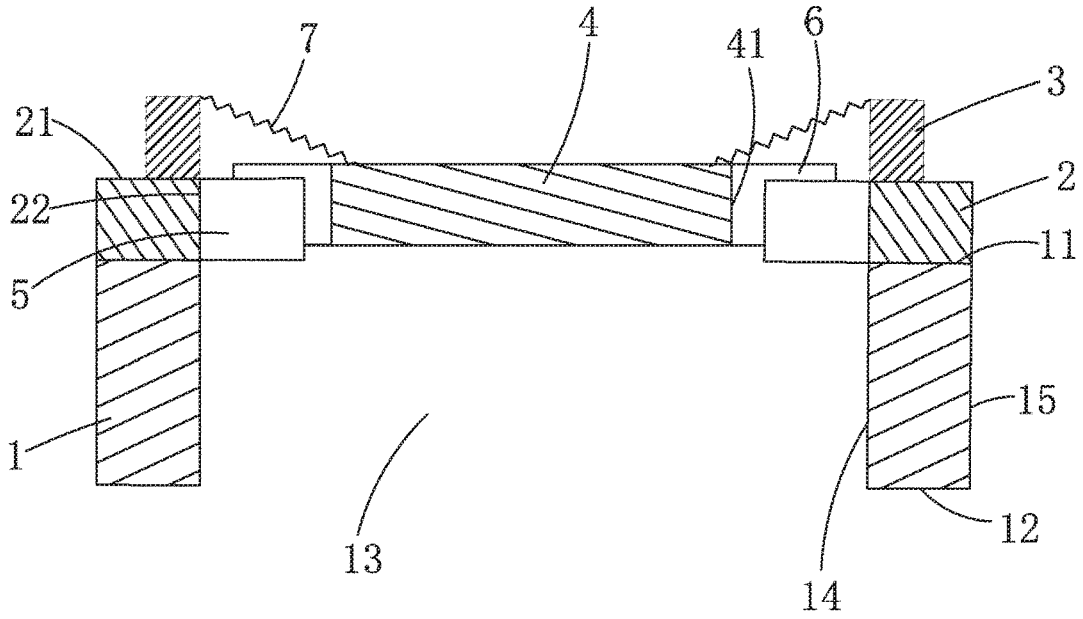
FIG. 5 is a cross sectional view of a sound transducer in which a first set of comb fingers are suspended.

The substrate 1 further comprises a fifth surface 14 and a sixth surface 15 which connect the first surface 11 to the second surface 12, and the fifth surface 14 and the sixth surface 15 are oppositely arranged. The fifth surface 14 is disposed toward the cavity 13 and forms a cavity wall. In the direction perpendicular to the first plane, the fifth surface 14 may or may not be disposed flush with the inner peripheral edge 22. Referring to FIG. 5 and FIG. 7, the fifth surface 14 and the inner peripheral edge 22 are flush with each other in the direction perpendicular to the first plane, and the first set of comb fingers 5 are suspended above the cavity 13. Referring to FIG. 4 and FIG. 6, in the direction perpendicular to the first plane, the fifth surface 14 corresponds to the moving structure 4, and the first set of comb fingers 5 are arranged on the first surface 11. In other embodiments, the fifth surface 14 can correspond to the support structure 2, and the first set of comb fingers 5 are suspended above the cavity 13.

Example 2

The differences between the present example and Example 1 lie in the structure and the number of the elastic structure 7. Only the differences are described in detail here, and other will not be described.

Figure 13:
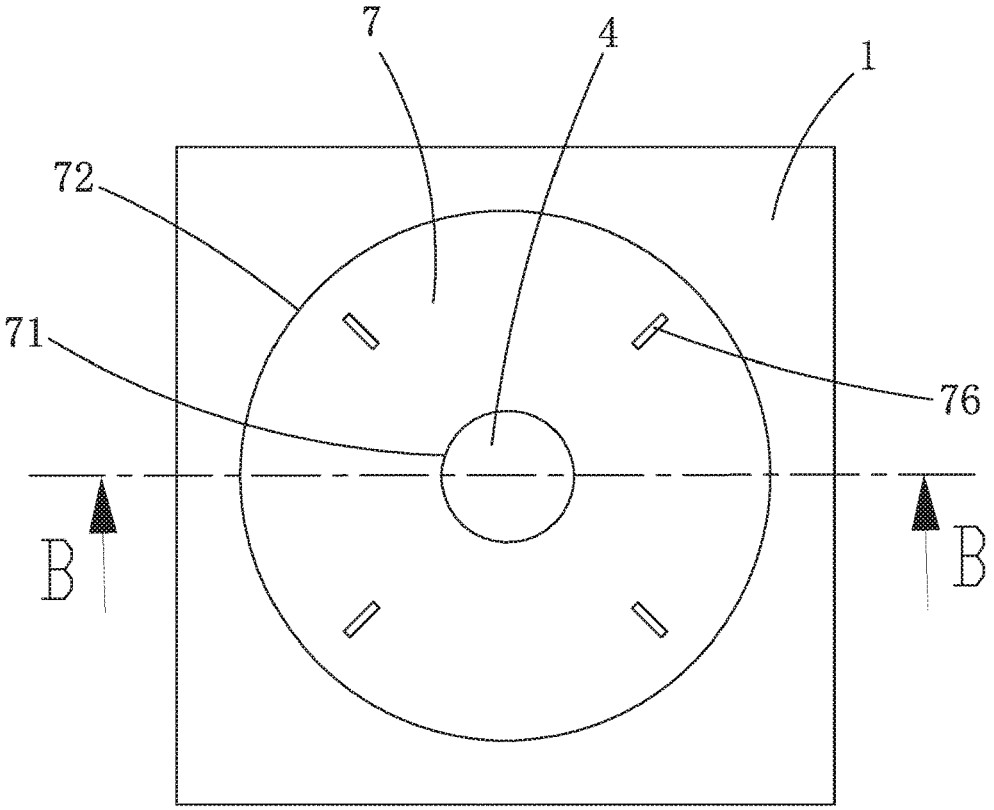
FIG. 13 is a top view of a sound transducer according to a second embodiment of the disclosure.

Please refer to FIG. 13, the sound transducer 100 comprises one elastic connecting structure 7, and the elastic connecting structure 7 is a ring structure. An inner side of the ring structure forms the first connecting part 71, an outer side of the ring structure forms the second connecting part 72, and the elastic body 75 is provided with a vent hole 76. By setting the vent hole 76, the static pressure on both sides of the moving structure 4 is equal when the moving structure 4 vibrates. In the embodiment, the elastic body 75 is provided with four vent holes 76. Understandably, the number of the vent holes 76 is not limited to that in the example.

Figure 14:
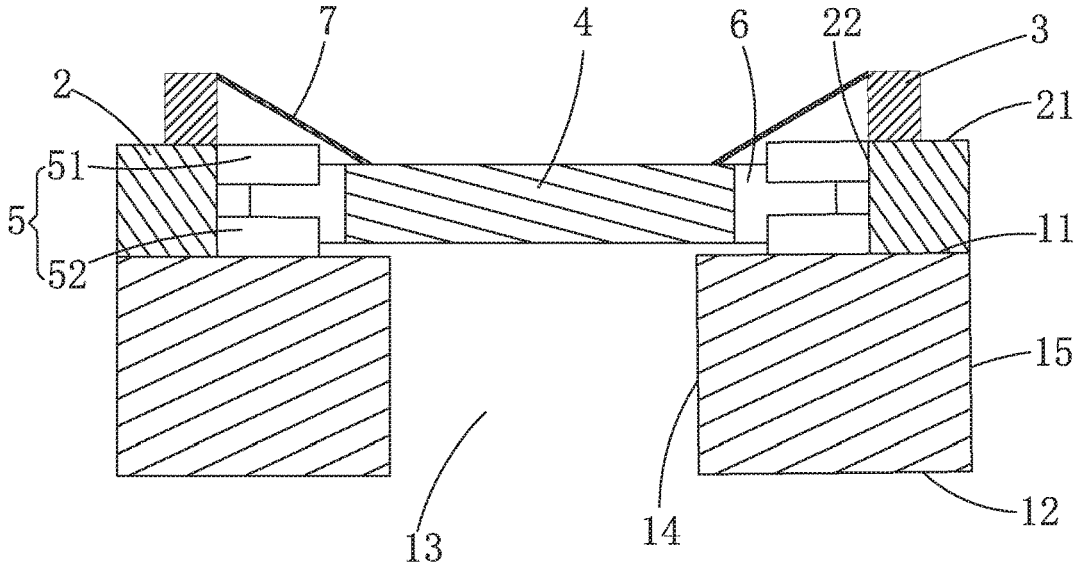
FIG. 14 is a cross sectional view taken from line B-B in FIG. 13.
Figure 15:
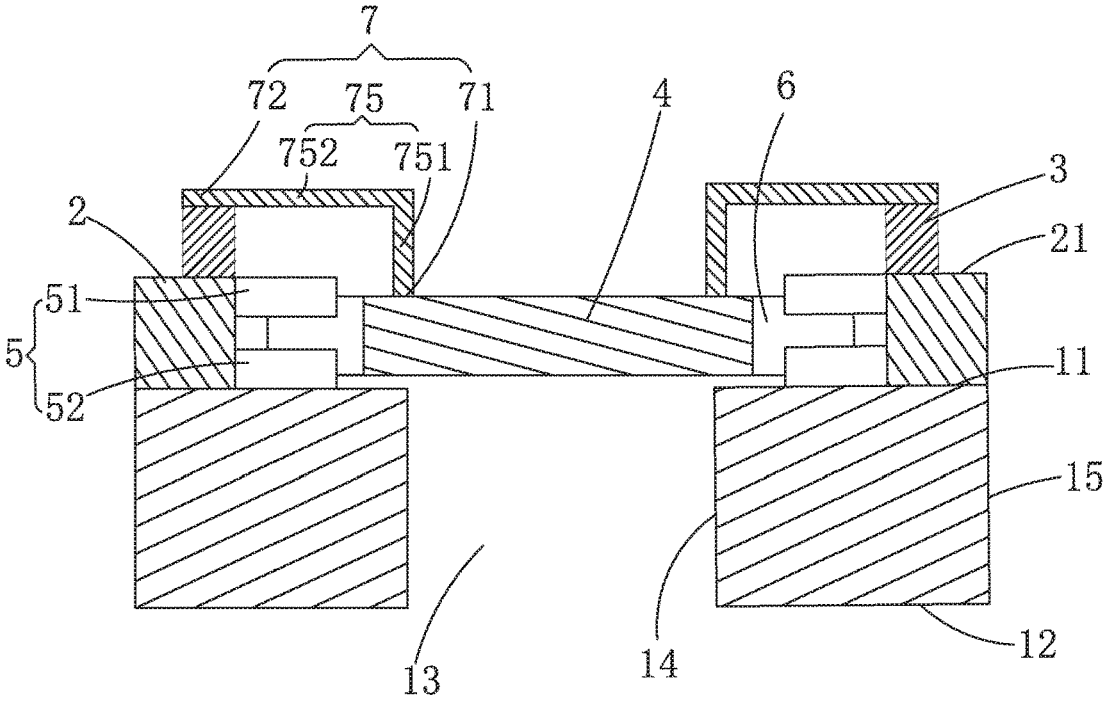
FIG. 15 is a cross sectional view of a sound transducer comprising another elastic body according the second embodiment of the disclosure.

Please refer to FIG. 14, the elastic body 75 extends from the first connecting part 71 away from the fourth surface 42 toward the second connecting part 72. Other structures are possible for the elastic body 75, please refer to FIG. 15, the elastic body 75 comprises a first body part 751 and a second body part 752, the first body part 751 extends from the first connecting part 71 in a direction away from the fourth surface 42, and the second body part 752 connects the first body part 751 to the second connecting part 72. Understandably, the structure of the elastic body 75 is not limited to that in the FIG. 14 and FIG. 15.

Example 3

The disclosure also provides an electronic device comprising a sound transducer 100 in the Example 1 or 2.

The above embodiments are only the preferred embodiments of the present disclosure, and do not limit the scope of the present disclosure. A person skilled in the art may make various other corresponding changes and deformations based on the described technical solutions and concepts. And all such changes and deformations shall also fall within the scope of the present disclosure.

The invention claimed is:

1. A sound transducer, comprising:

a substrate comprising:

a first surface;

a second surface being opposite to the first surface; and a cavity extending from the first surface to the second surface;

a support structure disposed on the first surface and comprising an inner peripheral edge near the cavity and a third surface away from the first surface;

a fixing structure disposed on the third surface;

a moving structure disposed above the cavity and at least partially covering the cavity, and comprising an exterior peripheral edge near the support structure and a fourth surface away from the cavity;

a first set of comb fingers fixed to the inner peripheral edge of the support structure, and extending toward the moving structure, and being electrically isolated from the fixing structure and the moving structure;

a second set of comb fingers fixed to the exterior peripheral edge of the moving structure, and extending toward the support structure; and an elastic connecting structure being configured to connect the fixing structure and the moving structure;

wherein the first set of comb fingers and the second set of comb fingers are interdigitated;

the elastic connecting structure comprises a first connecting part, a second connecting part, and an elastic body connecting the first and second connecting parts, the first connecting part is connected to the fourth surface, and the second connecting part is connected to the fixing structure.

2. The sound transducer of claim 1, wherein the first connecting part is provided with a first anchor connected to the fourth surface, the second connecting part is provided with a second anchor connected to the fixing structure, and the elastic connecting structure is configured to connect the moving structure to the fixing structure through the first and second anchors.

3. The sound transducer of claim 2, wherein the first anchor comprises a plurality of first sub-anchors, and/or the second anchor comprises a plurality of second sub-anchors; the plurality of first sub-anchors is connected to the fourth surface, and the plurality of second sub-anchors is connected to the fixing structure.

4. The sound transducer of claim 1, wherein the sound transducer comprises one fixing structure, the fixing structure is ring-shaped, and the second connecting part is connected to an inner side or a top of the fixing structure.

5. The sound transducer of claim 4, wherein the sound transducer comprises one elastic connecting structure, and the elastic connecting structure is a ring structure; an inner side of the ring structure forms the first connecting part, an outer side of the ring structure forms the second connecting part, and the elastic body is provided with a vent hole.

6. The sound transducer of claim 5, wherein the elastic body extends from the first connecting part away from the fourth surface toward the second connecting part.

7. The sound transducer of claim 5, wherein the elastic body comprises a first body part and a second body part, the first body part extends from the first connecting part in a direction away from the fourth surface, and the second body part connects the first body part to the second connecting part.

8. The sound transducer of claim 1, wherein the sound transducer comprises at least two fixing structures arranged separately in a circumferential direction, and the second connecting part is connected to an inner side or a top of the fixing structure.

9. The sound transducer of claim 8, wherein the sound transducer comprises one elastic connecting structure, and the elastic connecting structure is a ring structure; an inner side of the ring structure forms the first connecting part, an outer side of the ring structure forms the second connecting part, and the elastic body is provided with a vent hole.

10. The sound transducer of claim 9, wherein the elastic body extends from the first connecting part away from the fourth surface toward the second connecting part.

11. The sound transducer of claim 9, wherein the elastic body comprises a first body part and a second body part, the first body part extends from the first connecting part in a direction away from the fourth surface, and the second body part connects the first body part to the second connecting part.

12. The sound transducer of claim 4, wherein the sound transducer comprises at least two elastic connecting structures, and the two elastic connecting structures are arranged circumferentially along an inside of the fixing structure.

13. The sound transducer of claim 12, wherein the elastic body is a linear structure or a wavy structure.

14. The sound transducer of claim 13, wherein the wave structure is in a shape of sine waveform, square waveform, triangular waveform, or sawtooth waveform, or any combination thereof.

15. The sound transducer of claim 8, wherein the sound transducer comprises at least two elastic connecting structures, a number of the elastic connecting structure is the same as a number of the fixing structure, and the second connecting part of one elastic connecting structure is connected to one fixing structure.

16. The sound transducer of claim 15, wherein the elastic body is a linear structure or a wavy structure.

17. The sound transducer of claim 16, wherein the wave structure is in a shape of sine waveform, square waveform, triangular waveform, or sawtooth waveform, or any combination thereof.

18. The sound transducer of claim 1, wherein the moving structure is connected to at least one elastic connecting structure to form a resonant structure.

19. The sound transducer of claim 1, wherein the elastic connecting structure is made of a material comprising a conductive material, or a non-conductive material, or a combination thereof, or a stack thereof.

20. The sound transducer of claim 1, wherein the first surface is defined as a first plane, the first set of comb fingers comprise a first set of sub-comb fingers and a second set of sub-comb fingers, the first set of sub-comb fingers and the second set of sub-comb fingers are arranged separately in a direction perpendicular to the first plane, and both the first set of sub-comb fingers and the second set of sub-comb fingers are at least partially opposite to the second set of comb fingers in a direction parallel to the first plane; the first set of sub-comb fingers and the second set of sub-comb fingers are electrically isolated from each other.

* * * * *